US005913275A

United States Patent [19]

Flynn

[11] Patent Number: 5,913,275

[45] Date of Patent: Jun. 22, 1999

[54] MULTIPLE USE QUILTING FRAME

[76] Inventor: John F. Flynn, 1000 Shiloh Overpass Rd., Billings, Mont. 59106

[21] Appl. No.: 08/991,574

[22] Filed: Dec. 16, 1997

[51] Int. Cl.[6] ..... D05C 9/04; D05C 01/02

[52] U.S. Cl. ..... 112/119; 38/102.21

[58] Field of Search ..... 112/103, 117, 112/119; 38/102.21, 102.91; 160/378, 379, 375, 381

[56] References Cited

U.S. PATENT DOCUMENTS

| | | | |
|---|---|---|---|
| 23,631 | 5/1859 | Wetherill . | |
| 80,760 | 8/1868 | Nesbit . | |
| 253,352 | 2/1882 | Davis . | |
| 396,328 | 1/1889 | Davis | 112/119 |
| 409,143 | 8/1889 | Gibbs | 112/119 |
| 453,179 | 6/1891 | Davis | 112/119 |
| 581,063 | 4/1897 | Clayton . | |
| 599,092 | 2/1898 | Barron . | |
| 672,809 | 4/1901 | Russell . | |
| 811,650 | 2/1906 | Massey . | |
| 843,269 | 2/1907 | Gaines . | |
| 940,070 | 11/1909 | Russell . | |
| 988,913 | 4/1911 | vanDolsen . | |
| 1,326,776 | 12/1919 | Park . | |
| 1,732,660 | 10/1929 | Root . | |
| 1,843,834 | 2/1932 | Roberts . | |
| 1,973,370 | 9/1934 | Bynum . | |
| 2,000,397 | 5/1935 | Knutson | 38/102.21 |
| 3,908,293 | 9/1975 | Newman | 38/102.91 |
| 4,969,410 | 11/1990 | Brower et al. | 112/117 X |

*Primary Examiner*—Ismael Izaguirre
*Attorney, Agent, or Firm*—Jacobson, Price, Holman & Stern, PLLC

[57] ABSTRACT

A quilting frame which can be used in hand quilting or machine sewing quilting. The multiple use frame includes three parallel, spaced rods rotatably supported by a pair of parallel frame ends with the rods being individually rotated and individually locked in rotated position by interengaging splines on the ends of the rods and on the frame ends by the use of a screw threaded knob type wing nut. The top and bottom layers of the quilt are attached to certain of the rods, the batting inserted between the top and bottom layers and the three layers of the quilt are attached to and wound on a third rod. The rods are manipulated in a manner to effectively provide a quilting area for hand stitching or machine sewing with the rods maintaining the quilt components in a taut condition when stitching or sewing.

13 Claims, 3 Drawing Sheets

MULTIPLE USE QUILTING FRAME

BACKGROUND OF THE INVENTION

1. Field of the Invention

The present invention generally relates to a quilting frame which can be used in hand quilting or machine sewing quilting. The multiple use frame includes three parallel, spaced rods rotatably supported by a pair of parallel frame ends with the rods being individually rotated and individually locked in rotated positions by interengaging splines on the ends of the rods and on the frame ends by the use of a screw threaded wing nut knob. The top and bottom layers of the quilt are attached to certain of the rods, the batting inserted between the top and bottom layers and the three layers of the quilt are wound on one of the rods with the rods being manipulated in a manner to effectively provide a quilting area for hand stitching or machine sewing with the rods maintaining the quilt components in a taut condition when stitching or sewing.

2. Description of the Prior Art

The art of quilting has been used for many years and various devices to assist in completing a quilt are well known. The following U.S. patents are relevant to this field of endeavor.

| | | |
|---|---|---|
| 23,631 | 672,809 | 1,326,776 |
| 80,760 | 811,650 | 1,732,660 |
| 253,352 | 843,269 | 1,843,834 |
| 581,063 | 940,070 | 1,973,370 |
| 599,092 | 988,913 | |

In comparing the above listed prior patents with the present invention in the chronological order of the patents, U.S. Pat. No. 23,631 discloses a frame fixed on a stand which prevents it from being used in a machine quilting procedure. The pawls and notch tensioning system is unidirectional and not as positive as the spline connection between the frame ends and rods in this invention and the rods cannot be interchanged by providing removable fittings as in the present invention. U.S. Pat. No. 80,760 discloses a frame fixed to a stand which precludes the use with home sewing machines and the ratchet and pawl tension system is not positive and the length of the rollers or rods is not easily adjusted. U.S. Pat. No. 253,352 discloses a frame having only two rods or rollers and also includes the well known ratchet and pawl tension system. This frame is used for machine quilting only and is not capable of hand quilting. Also, the rods or rollers cannot be easily changed for different lengths. U.S. Pat. No. 581,063 discloses a frame with only two rods or rollers and also includes the ratchet tensioning system which requires a heavy rigid frame to maintain the tension. U.S. Pat. No. 599,092 discloses a frame that is fixed to a stand which precludes its use with a home sewing machine and also includes the ratchet and pawl tension system and the rods or rollers cannot be changed easily for variation in length.

U.S. Pat. No. 672,809 discloses a frame for hand quilting and also uses a ratchet and pawl tension system. U.S. Pat. No. 811,650 discloses a floor frame for hand quilting only and employs the ratchet and pawl tension system. U.S. Pat. No. 843,269 discloses a structure for suspending the frame from the ceiling. U.S. Pat. No. 940,070 discloses a floor frame constructed for hand quilting and the ratchet and pawl tension system is used to hold the rollers or rods in adjusted position. U.S. Pat. No. 988,913 discloses a rigid frame work having a ratchet and pawl tension mechanism which is not equivalent to the spline mechanism employed in this invention.

U.S. Pat. No. 1,326,776 discloses a device for hand quilting utilizing a ratchet and pawl tension system which is uni-directional as compared to the bi-directional spline system employed in this invention. U.S. Pat. No. 1,732,660 also discloses a frame with a gear and pawl tension system with the gear being more complicated to use and manufacture and the rod length cannot be changed in the manner as in the present invention. U.S. Pat. No. 1,843,834 discloses a frame with only two rods or rollers and the rollers or rods are held in place by friction as compared to the spline construction employed in this invention. U.S. Pat. No. 1,973,370 discloses a frame with three rails in which the rails can be interchanged but the fittings are of the ratchet and pawl type which are unidirectional and not as positive as the spline connection employed in this invention. The structure in this patent utilizes an overhead trolley system and employs various specific structural details not incorporated into the present invention.

Accordingly, while various quilting frames are disclosed, the manufacture and operation of the present invention is less complicated and the structure of the present invention is less bulky, economical to manufacture and relatively simple to operate and does not require an overhead track support and does not require a rigid stand.

SUMMARY OF THE INVENTION

The multiple use quilting frame of the present invention is capable of quilting by hand or by sewing machine. The frame includes two generally parallel frame ends and three, spaced, parallel rods disposed between and rotatably supported by the frame ends. The rods are located perpendicularly to the frame ends at each end thereof with a third rod located generally proximate to but spaced from one of the outer rods. Each end of each rod is provided with a radial splined surface and the frame ends include radially splined areas engaging the splined areas on the ends of the rods. Each end of each rod includes an axially extending threaded bolt extending through a corresponding hole in the frame ends with a knob type wing nut engaging the threaded bolt and the outer surface of the frame ends to rotatably lock the rods in relation to the frame ends when the wing nuts are tightened. The frame ends are constructed of a resilient material such as hard plastic and has a curvature incorporated therein so that when the wing nuts are loosened on one of the end rods, the ends of the frame ends will move outwardly and disengage the splined connection between the frame ends and that end rod to enable that end rod to rotate freely while leaving the other two rods securely locked. All or any of the knobs may be tightened or loosened during the use of the invention.

An object of the present invention is to provide a multiple use quilting frame enabling quilting by hand or by machine sewing.

Another object of the invention is to provide a quilting frame including three parallel rotatably supported rods mounted in perpendicular relation to a pair of frame ends.

A further object of the invention is to provide a quilting frame in accordance with the preceding objects in which the ends of the rods and the inner surfaces of the frame ends include interengaging radial splined surfaces for locking the rods in rotated position when wing nuts mounted on the ends of bolts extending through the frame ends from the ends of the rotatable rods are tightened.

Still another object of this invention is to provide a quilting frame in which the frame ends are bowed so that either of the end rods can be selectively loosened for rotation while the other rods are maintained in nonrotative relation to the frame ends thus enabling more efficient manipulation of the rods.

Yet another important object of this invention is to provide a quilting frame in accordance with the preceding objects in which the rotatable rods are provided with removable end fittings to enable the length of the rods to be varied by interchanging rods of different lengths thereby varying the width of the frame and the width of the quilt formed by the frame.

Still another unique feature of the present invention is to provide a quilting frame capable of quilting by hand or by sewing machine which is economical to manufacture and simple to use without requiring any overhead track support with the manufacture and operation being less complicated than existing quilting frames and the structure of the frame being less bulky than existing frames.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
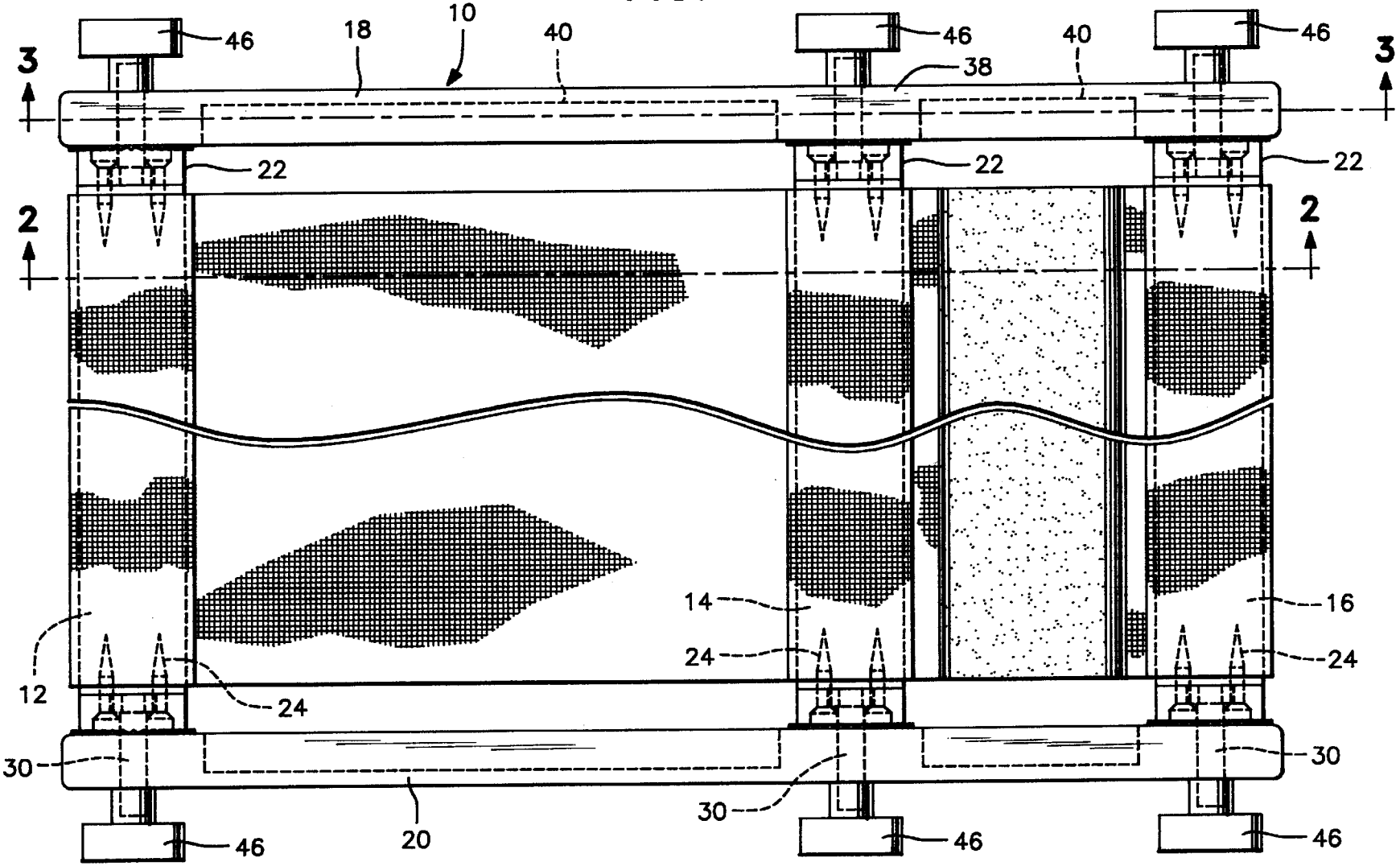
FIG. 1 is a plan view of the multiple use quilting frame of the present invention.

Although only one preferred embodiment of the invention is explained in detail, it is to be understood that the invention is not limited in its scope to the details of construction and the arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

The multiple use quilting frame of the present invention is generally designated by reference numeral 10 and includes three elongated wood rods 12, 14 and 16 which are oriented in parallel relation. The rods are supported at each end by a pair of generally parallel frame ends 18 and 20 with the rods being oriented in perpendicular relation to the frame ends. Each of the rods are of square cross-sectional configuration and constructed of wood and being of a predetermined length. Each end of each rod is provided with an end fitting 22 which is of square configuration, preferably constructed of rigid plastic material or the like and is secured to the end of the wood rod by a pair of counter-sunk screw fasteners 24 such as conventional wood screws. This enables the end fittings 22 to be attached to the rods and removed therefrom to enable interchange of rods so that rods of different lengths can be utilized with the frame ends 18 and 20.

Figure 7:
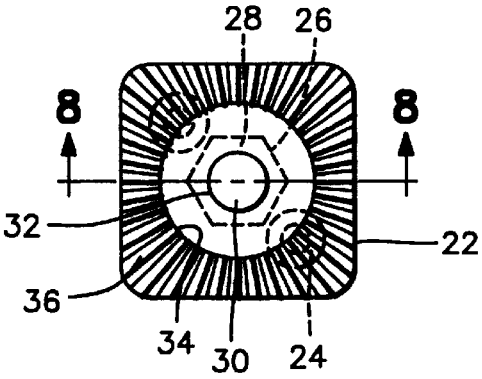
FIG. 7 is an end view of one of the rods illustrating the end fitting with the radial splined surface thereon and the projecting screw threaded bolt extending axially therefrom.
Figure 8:
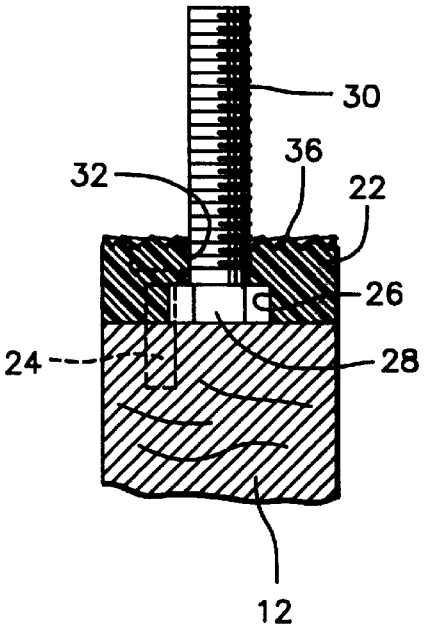
FIG. 8 is a detailed sectional view taken along section line 8—8 on FIG. 7 illustrating further structural detail of the rod, rod end fitting, radial splined surface and bolt extending therefrom.
Figure 9:
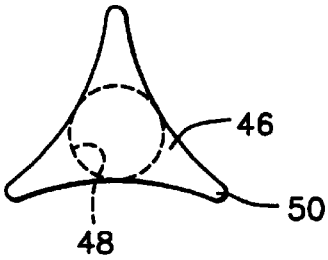
FIG. 9 is an elevational view of one of the knob type wing nuts for engagement with the threaded bolt at each end of the rotatable rods.

As illustrated in FIGS. 7 and 8, the interior of each of the end fittings or rod ends 22 is provided with a recess 26 which is of square or polygonal configuration for receiving a bolt head 28 with a threaded bolt 30 rigid with the bolt head extending out through a passageway 32 interconnecting the recess 26 with the external surface of the rod end 22 thereby precluding relative rotation between the bolt and the rod 12. The outer surface of the rod end 22 includes a cylindrical recess 34 at the center thereof and radially extending splines 36 from the periphery of the recess 34 to the square periphery of the rod end 22. The bolt 30 extends outwardly axially from the splined end of the rod end 22 as illustrated in FIGS. 7 and 8.

Figure 2:
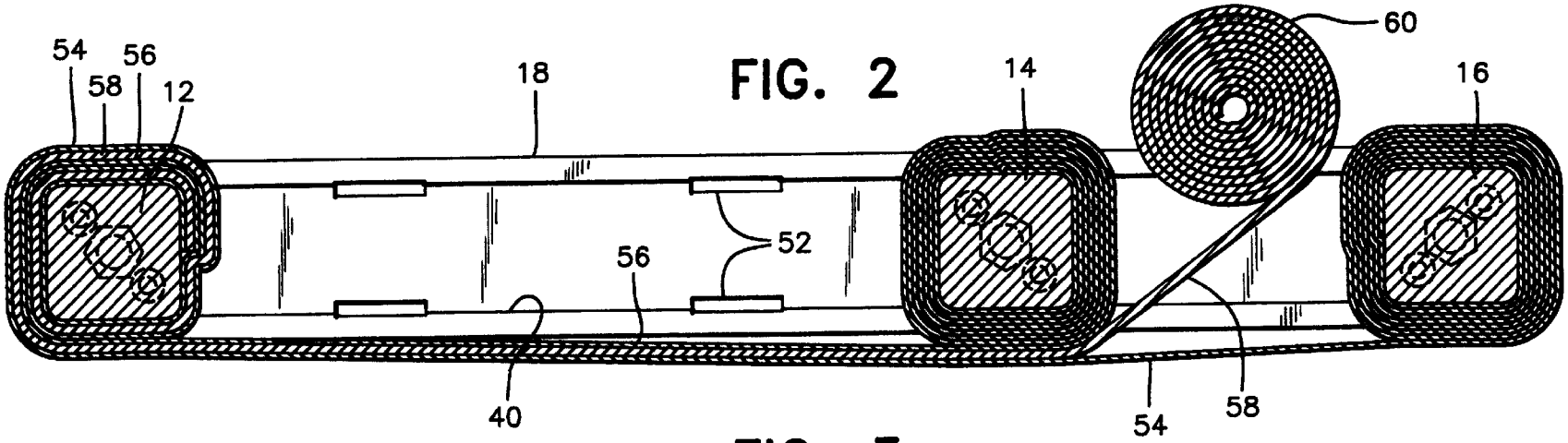
FIG. 2 is a longitudinal sectional view taken along section line 2—2 on FIG. 1 illustrating the structural arrangement of the rotatable rods and frame ends.
Figure 3:
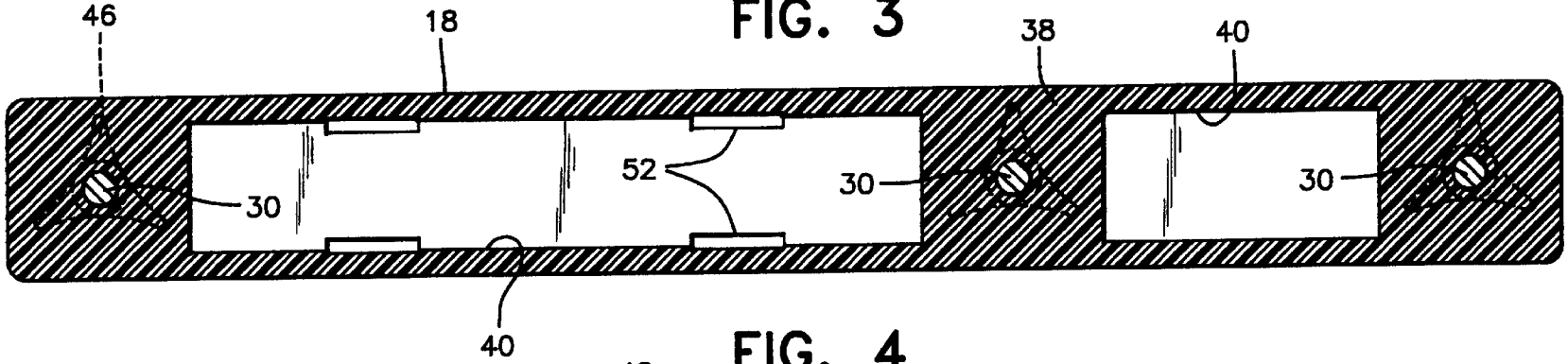
FIG. 3 is a longitudinal, sectional view taken along section line 3—3 on FIG. 1 illustrating structural details of a frame end.

The frame ends 18 and 20 are of the same construction with the frame end 18 being illustrated in FIGS. 2 and 3. The frame end 18 includes an elongated generally rigid plastic member 38 which includes recessed central portions 40 in certain areas thereof. The recessed areas 40 control the flexibility and weight characteristics of each of the frame ends. The frame end 18 includes three spaced radially splined surface areas 42 which interengage with the radial splines 36 on each end of the rods 12, 14 and 16 with the engaging splines locking the rods 12, 14 and 16 against rotation or permitting the rods to rotate. Each of the splined areas 42 is provided with a bolt hole 44 which receives the axially extending bolt 30 on opposite ends of the rods 12, 14 and 16. Threaded onto the outer end of each of the bolts 30 is a knob type wing nut 46 that includes an internally threaded socket 48 which is threaded onto the bolt and which includes an inner end engaged with the outer surface of the frame end 18. The knob type wing nut 46 includes three equally spaced projections 50 enabling a user of the frame 10 to easily rotate the knob type wing nuts 46 to tighten the frame ends 18 and 20 into locking engagement with the rods 12, 14 and 16 or enabling the frame ends to be loosened sufficiently to enable the rods 12, 14 and 16 to be rotated during use of the quilting frame.

Figure 4:
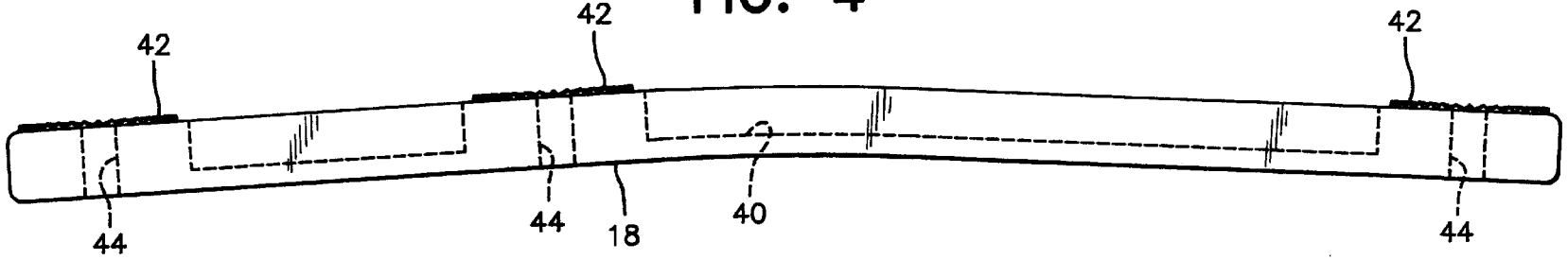
FIG. 4 is a top plan view of a frame end illustrating the bowed construction thereof.
Figure 5:
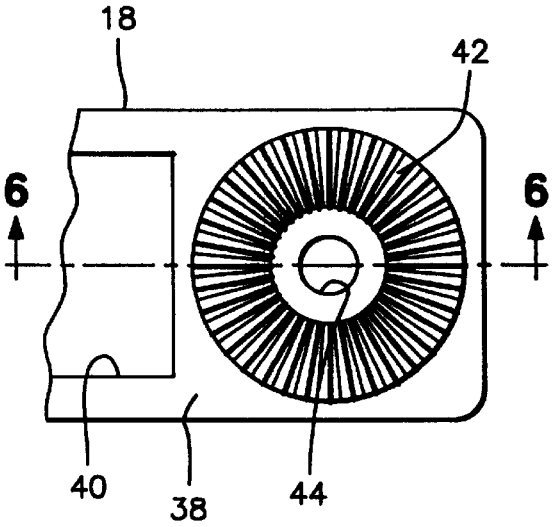
FIG. 5 is an enlarged elevational view of the inner surface of one end of a frame end illustrating the radial spline formed in the surface thereof.
Figure 6:
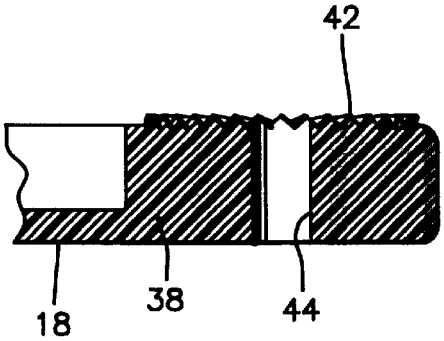
FIG. 6 is a detailed sectional view taken along section line 6—6 on FIG. 5 illustrating further structural details of the frame end.

As illustrated in FIGS. 2 and 3, the frame end 18 includes a pair of slots 52 adjacent the upper edge and a similar pair of slots 52 adjacent the lower edge with the slots being located in the recessed area 40 between rods 12 and 14. FIG. 4 illustrates the bowed configuration of the frame ends 18 and 20 in which the surface of the frame end having the splined areas 42 thereon is curved convexly and the outer being concavely curved with a slight degree of curvature so that the splined interengagement between the splined areas 42 on the frame ends and the splines 36 on the endmost rod ends 22 will bias apart due to the curvature of the frame ends when the wing nuts 46 are loosened thus facilitating the rotation of either one of the endmost rods while the remaining rods remain nonrotatable. The resiliency of the frame ends 18 and 20 is such that when the wing nuts 46 on one outer rod such as the rod 16 are loosened, the splined interengagement will disengage thus enabling manual rotation of the rod 16. Likewise, the rod 12 can also be independently rotated by loosening the wing nuts thereon without loosening the wing nuts on the other rods. Also, all of the wing nuts can be loosened to enable all of the rods to be rotated when necessary.

As illustrated in FIGS. 1–4, the rods 12, 14 and 16 are not equally spaced from each other inasmuch as the rod 14 is closer to the rod 16 than it is to the rod 12. For purposes of describing the operation of the multi-use quilting frame 10, the rods 12, 14 and 16 are also designated as rods A, B and C. The rods A, B and C are actually wood 2×2's (5.08 cm×5.08 cm) having a length of about 6 inches longer than the width of the quilting product to be made. The rods are cut with square ends perpendicular to the longitudinal axis thereof and the bolt 30 is inserted into the rod end 22 and the rod end secured to the ends of the rods in order to provide an assembled quilting frame. A 10 inch (25.4 cm) muslin starter cloth is fastened to each of the rods with staples, thumbtacks or the like and the center line of each rod and starter cloth is marked. A square is provided to mark line parallel to the rod on the muslin approximately 7½ inches (19.05 cm) from the rod. The back fabric piece 54 is squared off and is about 6 inches (15.24 cm) longer and 2 inches (5.08 cm) wider than the top fabric piece 56. The center line of the top fabric and back fabric are marked at each end. One end of the back fabric is then basted to rod A and the other end of the back fabric is basted to rod C with it being careful to line up the center lines and keeping the end of the back fabric on the 7½ inch (19.05 cm) line. Baste one end of the top fabric 56 to rod B being careful to line up the center line and keep the end on the 7½ inch (19.05 cm) line. The entire length of the back fabric 54 is then rolled onto the rod C as straight as possible until the two rods A and C are spaced apart the same distance as the A and C holes in the quilting frame. Then, the top fabric 56 is rolled onto the rod B as straight as possible. The frame is them assembled by putting on the frame ends 18 and 20 and installing and tightening the wing nuts 46. This condition is illustrated in FIG. 2 in which the back fabric 54 is wound on rod C and the top fabric 56 is wound on rod B. The batting 58 is fitted between the top and back layers and is provided with the necessary length of batting rolled loosely at 60 above the rod B or in the area above the rods B and C. With the frame laying flat on a table so all of the rods are parallel, the wing nuts are tightened on rod A which holds all three layers. Then rod B is loosened and rotated which holds the top until the top is taut at which time the wing nuts on rod B are tightened. Rod C is then loosened and turned which holds the back until the back is taut and tightened with the wing nuts on rod C. Then, leaving the wing nuts on one end of the frame tight, remove the wing nuts 46 and the frame end from the opposite end of the frame and slide the quilt frame into the sewing machine and replace the removed frame end back on the rods and replace the wing nuts 46. With the frame under the machine, strips of cloth may be inserted through the slots 52 in the frame ends and safety pins used to exert side tension on both sides. If necessary, a support may be provided such as a cylindrical pipe or mailing tube having a diameter equal to the height of the sewing machine deck to support the heavy end of the frame 10. The sewing machine is positioned in the middle of the table with the head pointing toward the user in order to comfortably quilt a quilt as long as the table. If a longer quilt is to be made on a particular size table, the sewing machine can be moved from one end of the table to the other as quilting progress across the frame. When machine quilting on the quilting frame of this invention, it is helpful to indicate the limit of the reach of the machine with a bright yarn stretched across the frame and taped thereto. Thus, free motion quilting can be accomplished with the present quilting frame and a conventional sewing machine.

When using the quilt frame for hand quilting, the back and top fabrics are placed in the same manner and center lines are marked as when machine quilting. In this arrangement, one end of the back fabric is basted to rod A and the other end to rod B with care being taken to line up the center lines and keeping the end of the back on the 7½ inch (19.05 cm) line. Then, baste one end of the top fabric to rod C being careful to line up the center line and keep the end on the 7½ inch (19.05 cm) line. Then roll the back fabric onto the rod B as straight as possible until rods A and B are spaced the same distance as the A and B holes in the frame ends of the quilting frame. The top fabric is then rolled onto the rod C as straight as possible and the frame is assembled by putting on the frame ends and installing the knob type wing nuts. In this arrangement, the batting also fits between the layers and is rolled loose underneath the rods B and C with the top side of the top fabric being exposed upwardly and the rods A, B and C being under the fabric layers. The layers are also basted together along the line adjacent the rod A. Thus, in this arrangement, the top fabric is uppermost and extends between rod A and rod C and the back fabric is lowermost and extends between rods A and B with the batting extending between the top fabric and back fabric by insertion between the layers in the area between rods B and C. Thus, with the frame positioned on a flat table the knob wing nuts are tightened and the operation is the same as when assembling the top and bottom areas and the batting sheet for machine quilting.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A multiple use quilting frame for use in hand quilting and machine quilting comprising three, generally parallel, spaced rods of equal length, a pair of generally parallel frame ends rotatably supporting the opposite ends of said rods, said rods being generally perpendicular to the frame ends, interengaging spline couplings between each end of each rod and said frame ends, and a manually actuated device at each end of each rod to selectively lock and unlock said interengaging spline couplings between the rods and frame ends to enable selective rotation and nonrotative locking of the rods in relation to the frame ends, said rods having top and back fabrics of a quilt attached thereto and wound and unwound therefrom, said top fabric being connected to the two outermost rods and the back fabric connected to one of the outermost rods and a rod positioned between the outermost rods to enable batting to be inserted between the top fabric and back fabric to form a quilt as the top and back fabric and batting are wound onto said one outermost rod with the area between said one outermost rod and the rod positioned between the outermost rods forming a working area for quilting the top fabric, batting and back fabric to form a quilt, each of said spline couplings including an end fitting detachably connected to each end of each rod, each end fitting including radial splines thereon to enable removal of said end fitting and interchange of rods of different length to enable the quilting frame to be used in forming quilts of different dimensions.

2. The quilting frame as defined in claim 1 wherein each of said spline couplings also includes radial splines on inner surface areas of each frame end for engagement with the radial splines on the end fittings on the rods.

3. The quilting frame as defined in claim 2 wherein each end fitting includes an axially extending threaded bolt thereon extending through a corresponding hole centrally located in the spline surface areas on the frame ends, said device for enabling selective rotation and nonrotative locking of the rods including a wing nut engaged with each of said bolts outwardly of the frame ends to lock the rods when the wing nuts are tightened to move the spline surface areas on the frame ends into locking engagement with the splines on the end fittings and enable rotation of the rods when the wing nuts are loosened.

4. The quilting frame as defined in claim 3 wherein each of said frame ends includes an elongated bowed member constructed of plastic material with an inner surface of the frame end being longitudinally convexly bowed and an outer surface concavely bowed, each frame end having sufficient flexibility and resiliency to enable wing nuts on the rods to be loosened and the spline surface areas on the frame ends disengaged from the splines on the end fittings on the rods to enable selective rotation and nonrotative locking of the rods by selective loosening and tightening of wing nuts to facilitate manipulation of the rods to provide a quilting area.

5. The quilting frame as defined in claim 3 wherein removing the wing nuts on all three rods at one end thereof enables one frame end to be separated from the rods thereby enabling the frame to be assembled with a sewing machine after which the removed frame end is replaced and the wing nuts replaced and tightened to facilitate machine quilting.

6. The quilting frame as defined in claim 3 wherein each of said rods is of square configuration and constructed of wood material, each end fitting being secured to the rod by wood screw fasteners.

7. The quilting frame as defined in claim 6 wherein each end fitting includes a polygonal recess in an inner surface, said bolt including a polygonal head received in said recess, said bolt extending from the recess through said hole and beyond the outer surface of the end fitting for enabling a bolt to be inserted through the end fitting with the polygonal head of the bolt secured in the recess to prevent relative rotation between the bolt and rod, said bolts extending through said frame ends and receiving said wing nuts for tightening and loosening the wing nuts for selective rotation and nonrotative locking of said rods in relation to the frame ends.

8. A multiple use quilting frame for use in hand quilting and machine quilting comprising three, generally parallel, spaced rods of equal length, a pair of generally parallel frame ends rotatably supporting the opposite ends of said rods, said rods being generally perpendicular to the frame ends, a manually actuated device at each end of each rod to selectively lock and unlock the rods and frame ends to enable selective rotation and nonrotative locking of the rods in relation to the frame ends, said manually actuated device at each end of each rod selectively connecting each end of each rod to said frame ends to enable one of said frame ends to be separated from said rods to enable the frame to be associated with a sewing machine after which the removed frame end is replaced, said rods having top and back fabrics of a quilt attached thereto and wound and unwound therefrom with the top fabric being connected to the two outermost rods and the back fabric connected to one of the outermost rods and a rod positioned between the outermost rods to enable batting to be inserted between the top fabric and back fabric to form a quilt as the top and back fabric and batting are wound onto one outermost rod, the area between said one outermost rod and the rod positioned between the outermost rods forming a working area for quilting the top fabric, batting and back fabric to form a quilt.

9. The quilting frame as defined in claim 8 wherein each of said rods includes an end fitting detachably connected thereto and including a portion of the manually actuated device thereon to enable removal of said portion of the manually actuated device and interchange of said rods of different length and replacement of said portion of said manually actuated device to enable the quilting frame to be used in forming quilts of different dimensions.

10. The quilting frame as defined in claim 8 wherein each of said frame ends includes an elongated bowed member, an inner surface of the frame end being longitudinally convexly bowed and an outer surface concavely bowed, said frame end having sufficient flexibility and resiliency to enable said manually actuated device on one of the rods to be loosened with the manually actuated device on the other two rods remaining securely locked against rotation in relation to the frame ends to facilitate manipulation of the rods to provide a quilting area.

11. The quilting frame as defined in claim 8 wherein said manually actuated device at each end of each rod includes one end surface defining radial splines, each of said frame ends including surface areas defining radial splines for engagement with the radial splines on the rod ends.

12. The quilting frame as defined in claim 11 wherein each end surface on each rod includes an end fitting, an axially extending threaded bolt on each end fitting, each bolt extending through a hole located in a splined surface area on the frame end, and a nut engaged with each of said bolts to engage the radial splines and lock the rods when the nuts are tightened and enable rotation of the rods when the nuts are loosened.

13. The quilting frame as defined in claim 12 wherein each end fitting includes a polygonal recess in an inner surface, said bolt including a polygonal head received in said recess, said bolt extending from the recess through said end fitting and hole in the frame end for enabling a bolt to be inserted through the end fitting with the polygonal head of the bolt secured in the recess to prevent relative rotation between the bolt and rod, said bolts receiving said nuts for tightening and loosening the nuts for selective rotation and nonrotative locking of said rods in relation to the frame ends.

* * * * *